United States Patent [19]

Salmon

[11] Patent Number: 4,508,298

[45] Date of Patent: Apr. 2, 1985

[54] APPARATUS FOR LOCALIZING OF A TRAIN

[75] Inventor: Jean P. Salmon, Aulnay sous Bois, France

[73] Assignee: Jeumont-Schneider, France

[21] Appl. No.: 387,173

[22] Filed: Jun. 10, 1982

[30] Foreign Application Priority Data

Jun. 10, 1981 [FR] France ..... 81 11371

[51] Int. Cl.[3] ..... B61L 3/00

[52] U.S. Cl. ..... 246/167 R; 246/63 R; 246/122 R

[58] Field of Search ..... 340/904; 246/167 R, 246/122 R, 63 R, 63 A; 343/6.8 R, 6.5 SS

[56] References Cited

U.S. PATENT DOCUMENTS

| | | | |
|---|---|---|---|
| 1,524,429 | 1/1925 | Gewecke | 246/63 R |
| 3,284,614 | 11/1966 | Bramer | 235/92 |
| 3,426,349 | 2/1969 | Gareis | 343/6.8 R |
| 3,940,765 | 2/1976 | Grafinger | 246/122 R |
| 4,041,448 | 8/1977 | Noens | 340/32 |
| 4,274,611 | 6/1981 | Salmon | 246/63 R |

FOREIGN PATENT DOCUMENTS

| | | |
|---|---|---|
| 1405711 | 10/1968 | Fed. Rep. of Germany . |
| 1560903 | 3/1969 | France . |

*Primary Examiner*—James J. Groody

*Attorney, Agent, or Firm*—Rines and Rines, Shapiro and Shapiro

[57] ABSTRACT

The invention has as its goal a device for extremely precise localization of a train circulating on a railway, and necessitating no complex circuit on the ground. According to the invention, the apparatus comprises, on board the train and in front of its first axle, at least one tuned emitter fixed at an electromagnetic radio frequency, and a receiver provided with two detectors. On the ground, a passive loop tuned to the frequency used, is disposed between the two rails of the track, with the detectors and emitter being disposed in such a manner that there is not direct induction between them.

5 Claims, 3 Drawing Figures

APPARATUS FOR LOCALIZING OF A TRAIN

The present invention concerns apparatus for localization of a train circulating on a steel railway.

Such an apparatus finds application in systems of automatic train operation, for which the precise localization of the train on the track is extremely important. In such a case, the use of an odometer counter on board is insufficiently precise, due to the slippage of the wheels on the rails, and the wearing of the wheels.

For this reason, it is customary to make use of beacons emitting electromagnetic radio frequencies along the track at determined distances, in order to ensure periodic recalibration of the counters. Notwithstanding, such a solution presents the drawbacks, on the one hand, of utilizing radio frequencies which could be required for other purposes, and, on the other hand, of requiring the deployment of costly beacons, to which it is necessary to ensure electrical power supply by means of cables disposed along the track.

The present invention has as its object to provide a new and improved apparatus of this character that obviates these drawbacks by means of an apparatus in which the part on the ground is passive, and requires no power supply, and the part on board makes use of an electromagnetic radio frequency which can, in addition, be used simultaneously for other purposes, such as the transmission of information between the rails and the train.

A further object is to provide an improved train or similar localization apparatus of more general utility, as well.

Other and further objects will be explained hereinafter and are more particularly delineated in the appended claims.

In summary, however, the invention embraces apparatus comprising, on board the train, and in front of its first axle, a tuned emitter fixed at an electromagnetic radio frequency and a receiver tuned to the same frequency, provided with two detectors placed essentially vertically above the two rails of the track; and, on the ground between the two rails of the track, a passive rectangular loop including a tuning condenser for enabling tuning to the same frequency, one side of which is substantially tangent to a rail in such fashion that the emitter induces a distinct signal in one of the detectors only through the intermediary of the loop at the time of passage of the on-board part of the apparatus above the loop on the ground.

Figure 1:
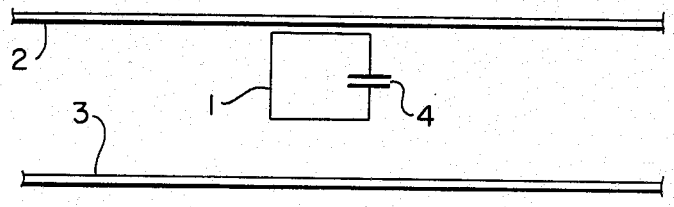
Figure 2:
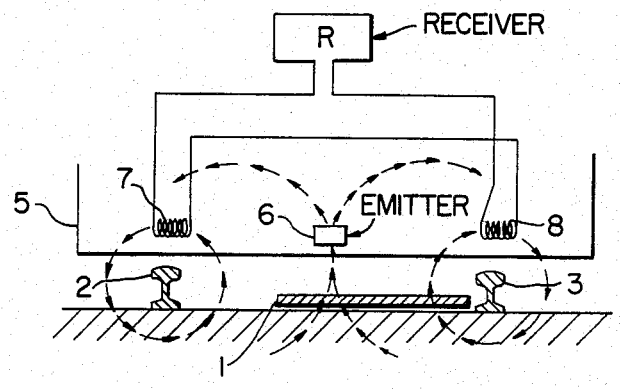
Figure 3:
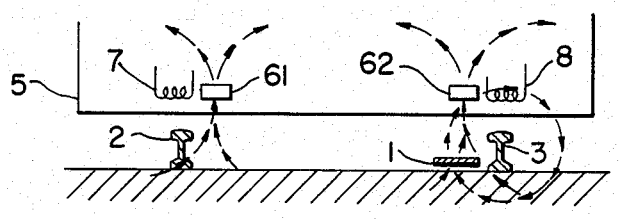

The invention will be better understood, and other goals, advantages and characteristics will become more clear from the reading of the following description of best modes of realization, not intended as limitational, and presented in connection with the accompanying drawing:

FIG. 1 of which represents a schematic circuit (viewed from above) of the two rails, between which is placed a passive loop conforming to the invention; and FIGS. 2 and 3 represent, in transverse section and schematically, two alternative modes of realization of the apparatus conforming to the present invention.

Referring to FIG. 1, a rectangular loop or similar antenna or related circuit 1 is positioned asymmetrically between the two rails of the tracks 2, 3, one of its sides being substantially adjacent to one of the rails (shown as the rail 3), and with the loop tunable to the chosen frequency by means of a condenser 4.

Referring to one of the preferred modes of realization of the invention as represented by FIG. 2, the train 5 has on board a tuned emitter 6, transmitting an electromagnetic radio frequency, and a receiver R tuned to the same frequency comprising a pair of laterally spaced detectors 7, 8, disposed in the train respectively essentially vertically above each of the corresponding rails 2, 3. The device is thus said to employ central emission. Detectors 7, 8 and the central emitter 6 are placed in front of the first axle of the train.

When the train passes by the loop 1, or, more precisely, when the on-board emitter 6 passes above the loop 1, a current is induced in the loop. The loop current in turn induces in the lateral detector 8 so that the on-board receiver detects a signal (the total receiver circuit not being shown in order not to detract from the essential features of the invention), which signal is used, for example, to recalibrate an odometer counter, or to increment a numerical counter or other on-board indicator.

The electric fields have been represented in the drawings by means of arrows, and it can thus be confirmed that, by judicious placement of the detectors 7, 8 with respect to the emitter 6, there will be no noticeable direct induction between them.

By connecting the two lateral detectors 7 and 8 in a differential assembly, furthermore, one eliminates the currents induced in phase opposition emanating from the currents circulating in each of the rails. However, since the loop is coupled more closely to one of the detectors (8) than to the other, the loop current produces an unbalance in the detector signals and hence an output in the receiver.

In the modification of realization represented in FIG. 3, two lateral emitters 61, 62 are used, placed at equal distance from the two rails of the track in the vicinity of the respective detectors 7 and 8, but having identical operation with a differential distinct signal occuring at 8 in view of the presence of the loop 1. Such a configuration permits reduction of the dimensions of the ground loop.

With a central emitter device 6 as represented in FIG. 1, the width of the loop may be about 1 meter; while with a device with two lateral emitters 61, 62, as represented by FIG. 2, the width of the loop can be reduced to about 40 cm. In both cases, the loop 1 can comprise one or a number of windings.

Such a device presents the fundamental advantage of necessitating no power supply on the ground, nor an electronic circuit on the ground to be protected. Furthermore, it can be used whatever the type of drive circuit with which the railroad is equipped, and, in particular, with an impulse drive circuit.

Although only two preferred modes of realization have been described, it is obvious that other modifications in the same spirit can be made by those skilled in the art without departure from the scope of the present invention.

I claim:

1. Apparatus for localization of a train circulating on a two-rail steel track, having, in combination, on board the train, radio-frequency emitter means tuned to a predetermined radio frequency and receiver means tuned to the same frequency and provided with two detectors situated above said rails, respectively, and, on the ground, a passive radio-frequency circuit tuned to the same frequency and positioned to receive a radio-frequency signal from said emitter means, said apparatus having means for preventing said emitter means from producing an output in said receiver means except when said emitter means induces a signal in said passive radio-frequency circuit, said radio-frequency circuit being more closely coupled to one of said detectors than to the other such that a signal induced in said circuit from said emitter means induces a signal in said one detector and thereby produces an output in said receiver means.

2. Apparatus in accordance with claim 1, wherein said radio-frequency circuit comprises a loop with a tuning capacitor therein, said loop being disposed asymmetrically between said rails and having one side adjacent to one of said rails.

3. Apparatus in accordance with claim 1, wherein the detectors are connected differentially to eliminate currents induced in phase opposition emanating from each of the rails.

4. Apparatus in accordance with claim 1, wherein the emitter means comprises an emitter disposed substantially equidistant from the detectors.

5. Apparatus in accordance with claim 1, wherein the emitter means includes two emitters disposed adjacent to the detectors, respectively.

* * * * *